US005611761A

United States Patent [19]

Brown

[11] Patent Number: 5,611,761

[45] Date of Patent: Mar. 18, 1997

[54] THERAPEUTIC DEVICE

[76] Inventor: Michael A. Brown, 434 Triangle Ave., Dayton, Ohio 45419

[21] Appl. No.: 205,572

[22] Filed: Mar. 3, 1994

[51] Int. Cl.[6] ..... A63B 9/00

[52] U.S. Cl. ..... 482/87; 482/83; 473/442

[58] Field of Search ..... 446/5, 228, 324, 446/325, 394, 29; 472/118; 482/83, 85, 86, 84, 87, 89, 90; 297/DIG. 1, DIG. 2, 118, 122, 123, 133

[56] References Cited

U.S. PATENT DOCUMENTS

| | | | |
|---|---|---|---|
| 1,557,938 | 10/1925 | Kennedy | 482/87 |
| 1,637,561 | 8/1927 | French | 482/86 |
| 1,708,638 | 4/1929 | Smith | 482/87 |
| 1,870,748 | 8/1932 | Ramey | 472/118 |
| 2,643,124 | 6/1953 | Malone | 482/87 |
| 2,661,212 | 12/1953 | Hilton | 482/87 |
| 4,403,356 | 9/1983 | Urai | 297/DIG. 1 |
| 5,161,522 | 11/1992 | Clevenger | 128/845 |
| 5,280,905 | 1/1994 | Micco | 482/86 |

*Primary Examiner*—Jerome Donnelly
*Attorney, Agent, or Firm*—R. William Graham

[57] ABSTRACT

The present invention is directed to a therapeutic device, comprising a generally onion shaped body having a relatively elongated end and a relatively enlarged bulb end on which an individual sits, wherein the body is of a size and configuration to enable a range of various aged and sized individuals to sit on the enlarged bulb end and grasp the elongated end and the body is constructed of an outer shell of a sheet-like material and a cushion insert so that substantially all surface contact points of the body are of a predetermined softness, the shell has a fastenable section which readily opens and closes, wherein the insert is readily insertable through the fastenable section and disposable within the shell such that the fastenable section is closed and the shell encloses the insert and imparts the onion shape thereto.

7 Claims, 2 Drawing Sheets

THERAPEUTIC DEVICE

BACKGROUND OF THE INVENTION

The present invention relates to a therapeutic device and more particularly to a therapeutic swinging device which is constructed to provide therapy for persons having neurophysiological dysfunctions and other handicaps.

Therapeutic devices exist which attempt to create a flexion pattern in a patient to stimulate a desired neurological response deemed beneficial to the patient. A flexion pattern is the effect which is normally felt by a person when moving or bending a particular part of the body in a particular manner. Prior devices utilize a swing seat or the like suspended by a rope, chain or rigid post which the user grasps while sitting on the swing seat. In either the case of a rope, chain, or rigid post-like connection to the swing seat, the user can injure himself or herself with these types of suspension as the device swings back and forth in a multidirectional area. In one case, a bean bag type seat is suspended solid suspension bar which runs internally into the bag, the bar which presents a potential risk to the user or those nearby as the device swings. Furthermore, prior devices used were of limited capacity in that the user could experience only a flexion pattern with each device and the device was typically limited to a defined class of users.

There remains a need for a therapeutic device which is capable of providing multiple or graded flexion patterns and which is capable of use by widely varying aged patients. There is also a need for making such device safer for use. There is also a need for providing such a device in a relatively inexpensive manner.

SUMMARY OF THE INVENTION

It is an object of the present invention to provide a device capable of providing graded flexion patterns in a patient suspended thereby to induce a beneficial neurophysiological effect.

It a further object of the present invention to provide a therapeutic device which can accommodate varying aged patients ranging from several years to geriatric age.

An additional object of the present invention is to provide a therapeutic device of the type described which is of a light weight and durable construction, which is useful both indoors and outdoors.

It is another object of the present invention to provide a therapeutic device of the type described which is economically constructed.

Still another object of the present invention is to provide a safer therapeutic device.

Other objects of the present invention will be readily apparent to those skilled in art upon reading the following detailed description and claims appended hereto.

Accordingly, the invention is directed to a therapeutic device, comprising a generally onion shaped body having a relatively elongated end and a relatively enlarged bulb end on which an individual sits, wherein the body is of a size and configuration to enable a range of various aged and sized individuals to sit on the enlarged bulb end and grasp the elongated end. The body is constructed of an outer shell of a sheet-like material and a cushion insert so that substantially all surface contact points of the body are of a predetermined softness. The sheet-like material of the outer shell has a fastenable section which readily opens and closes, wherein the insert is readily insertable through the fastenable section and disposable within the shell such that the fastenable section is closed and the shell encloses the insert. The insert imparts the onion-like shape to the body when inserted therein. The elongated end terminates in a looped portion for connecting to a support hook or the like.

DESCRIPTION OF THE DRAWINGS

The accompanying drawings form a part of the specification and are to be read in conjunction therewith, in which like reference numerals are used to indicate like parts in the various views.

DETAILED DESCRIPTION OF THE PREFERRED EMBODIMENT

Figure 2:
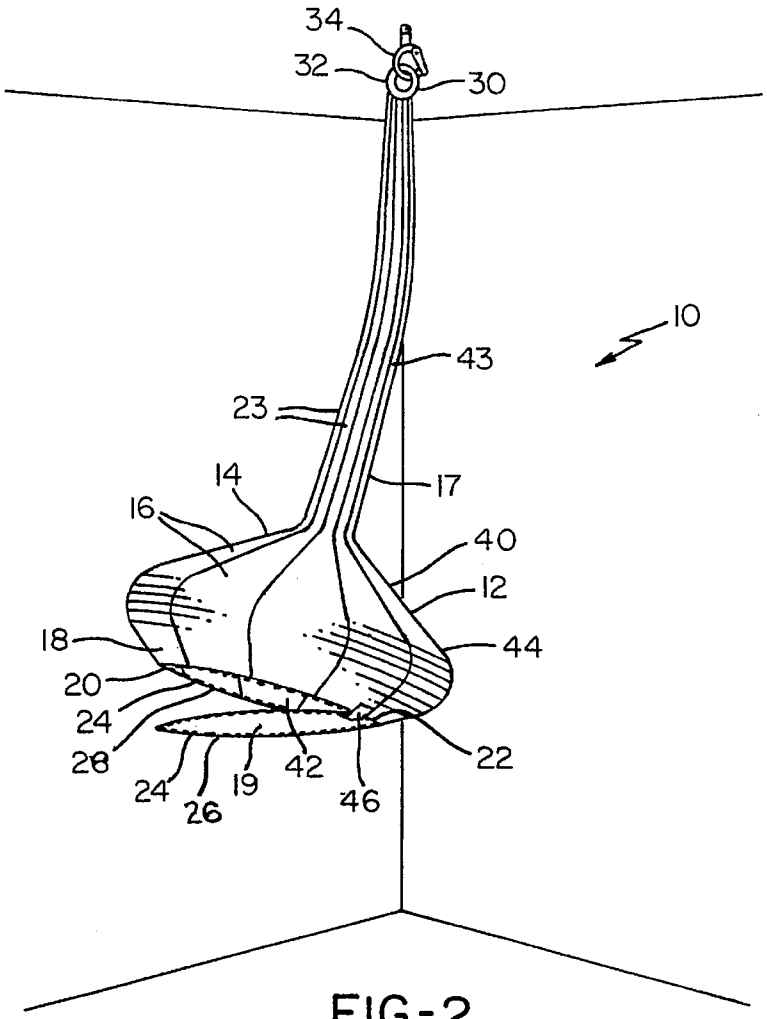
FIG. 2 is a side perspective view of the device with a portion thereof opened.
Figure 1:
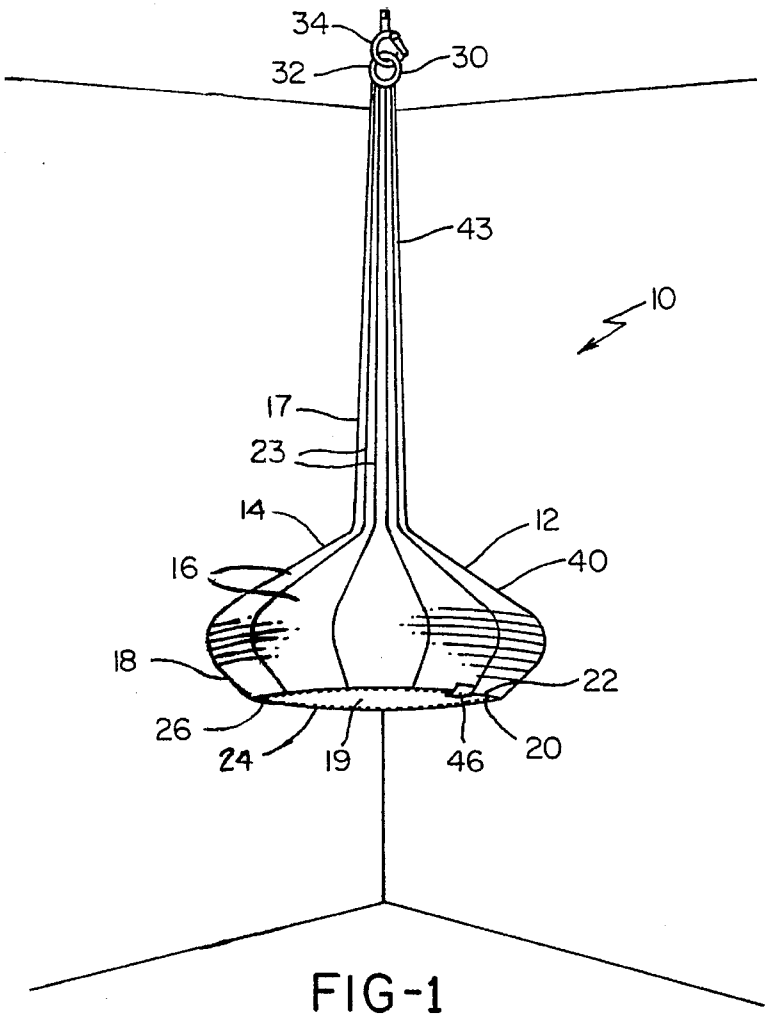
FIG. 1 is front view showing a therapeutic device constructed in accordance with a preferred embodiment of the present invention suspended from a ceiling.

Referring now to the drawings, numeral 10 generally designates a therapeutic device (swing) which is constructed in accordance with the present invention and which is intended for use primarily by individuals having neurophysiological disorders which emanate from birth defect or a physiological event or accident during their lives. In order to treat such disorders of the nervous system, therapists have developed and continue to develop ways to stimulate normal physiological response in the patient. Stimulation is effected, for example, by moving the patient through various flexion pattern or providing a device for the patient to touch and squeeze. As will be apparent from the disclosure hereafter, one of the important aspects of the present invention is its ability to provide multiple stimulus to accommodate the particular individuals stimulation needs.

The body of the therapeutic device 10 is generally designated by the numeral 12 and includes an outer shell 14 of flexible sheet-like material. The material of shell 14 is of a durable construction such as urethane, dacron, or synthetic material, such as nylon, or polyvinyl material. A woven construction having slight elasticity to give and return to its original state is desirable. Other suitable materials will be readily apparent to those skilled in the art. The shell 14 is comprised of a plurality of onion-shaped pieces 16 having a relatively narrow end 17 gradually increasing in width for a distance, then bowing outwardly for another distance at the other end 18. Each piece 16 is approximately 5 feet in length with the end 17 being about ¾ of total length. The body 12 also has a generally circular piece 19 which is connected along a peripheral edge portion 20 to a terminal portion 22 of one of the pieces 16. The piece 19 is approximately 16 inches in diameter. Pieces 16 are connected to one another (sewn, for example) at their edges 23.

A zipper 24 is sewn to and interconnects a remaining peripheral portion 26 of the piece 19 to the other terminal portions 28 of the pieces 16. It is noted in the present invention that other means for fastening the material 14 together may be employed as well as the location for such means. For example, a Velcro® fastener can be used to connect a horizontal or latitudinal seam between adjacent pieces 16 and/or 19. The zipper 24 permits the shell 14 to be opened to allow insertion and interchanging of inserts described hereinafter and closed to maintain the inserts within the shell 14.

Terminal portion 30 and ends 17 join together to form a loop arrangement 32. A hook 34 or the like inserts through the loop arrangement 32. The hook 34 is of a design to clip onto the loop arrangement 32 and readily release from the loop arrangement 32, if so desired. It is contemplated that the hook 34 may be of a swivel type.

Figure 3:
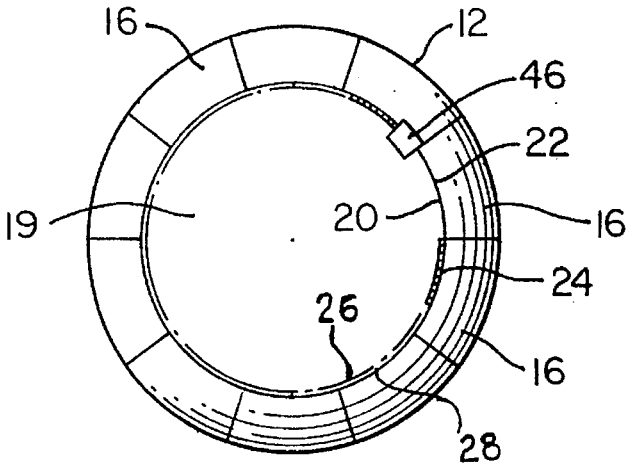
FIG. 3 is a bottom view of the therapeutic swing of the present invention.

FIG. 3 is a bottom view better showing piece 16 attached to piece 19 at terminal portion 22, with terminal portions 28 of pieces 16 being fastened to peripheral portion 26 of piece 19 by zipper 24.

Figure 4:
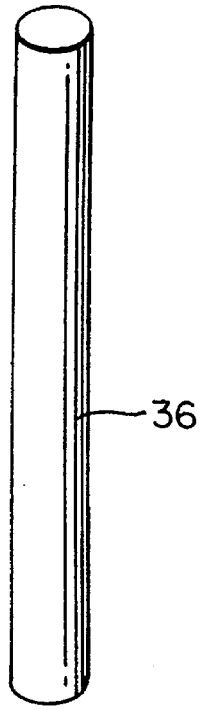
FIG. 4 is a perspective view of a cylindrical insert for the therapeutic device.
Figure 5:
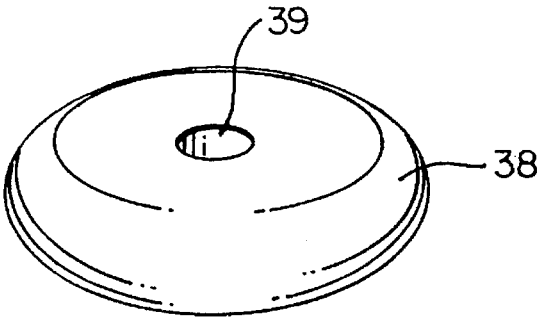
FIG. 5 is a doughnut-like insert for the therapeutic device.

FIG. 4 shows a generally cylindrical insert 36. The insert 36 is of a flexible nature and is made from a polyfoam material, such as polyethylene. FIG. 5 shows a doughnut insert 38 which is made in a pillow type fashion stuffed with filler as is known in the art, such as chopped polyfoam fill, polyester fiber fill, styrofoam bead fill, but alternatively could be made from a single polyfoam insert. Insert 36 can act as an internal anchor for the doughnut insert 38, wherein one end of the insert 36 can extend into and against the orifice surface 39 of the insert 38.

As a novel feature of the present invention, the device 10 permits the inserts 36 and 38 to be changed with other similar inserts of different density and firmness. Varying the insert density and firmness imparts different tactile feels and induces graded flexion patterns to suit the particular user's needs. Grading is the concept of giving the same piece of equipment the capability of being used by individuals requiring more or less stimulus.

A seat surface 40 of the body 12 is formed by the combination of the inserts 36 and 38 being disposed within the shell 14 such that a t-type configuration or flexion disc configuration is formed.

Figure 6:
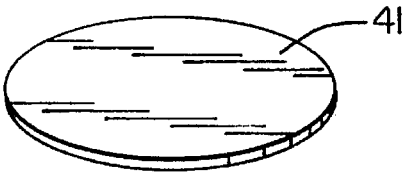
FIG. 6 is a disc-like insert for the therapeutic device.

Additionally, a relatively thin disc 41, as shown in FIG. 6, can be provided to lend support to the insert 38. The disc insert 41 is of a semi-rigid construction such as a dense polyfoam material.

While there has been shown a number of inserts which are used in the present invention, it is contemplated that single inserts of varying densities, each such insert shaped to fill the space within the shell may be used to effect a similar result. Alternatively, a greater number of inserts may be used at various points throughout the body 12 to achieve a desired flexion pattern. For purposes of packaging, separate inserts are desirable.

In assembling the device 10, the cylindrical insert 36 is inserted into the body 12 through an opening 42 and into the elongated neck 43 of the body 12, when the piece 19 is unzipped from the pieces 16. The doughnut 38 is inserted into the enlarged bulb end 44 and optionally, the support disc 41 can be placed into the bulb end 44. The insert 36, doughnut 38 and disc 41 are enclosed within the body 12 by zipping the piece 19 to the pieces 16. A zipper cover 46 or fly is also provided to cover a zipper latch, once pieces 19 and 16 are zipped together.

The insert 36 is of a size and configuration to substantially fill the space provided within the elongated neck 43. Likewise, the doughnut 38 and disc 40 are of a size and configuration to substantially occupy the space within the enlarged bulb end 44.

In its most intended use, the device 10 is suspended by its loop 32 and rotational swivel hook 34. This type of suspension allows the body 12 to swing back and forth and rotate while experiencing a slight bending of the neck 43 to deliver a unique flexion pattern. Additionally, as inserts are changed to others of different densities, the flexion pattern is likewise affected to deliver a different neurological response. The device 10 may optionally be set on a floor and straddled by the user to induce yet another neurophysiological response.

Unlike the prior known devices, the therapeutic device of the present invention is provided having substantially all contact points being relatively soft. The ability to vary the swing's softness and weight is important, because each affects the way in which the body of the device moves, bends and feels to the patient. One or more of these combinations of weight and density may prove more beneficial for a particular clients neurophysiological needs.

While the preferred embodiment has been set forth above, it is contemplated that many modifications, derivations, and improvements will be obvious to those skilled in the art and that the claims appended hereto should be accorded the benefit of such modifications, improvements and derivations.

What is claimed:

1. A therapeutic device for treating an individual having a neurophysiological dysfunction, comprising:

a flexible body having a relatively enlarged end on which the individual sits and relatively elongated end of a length at least that of the individual's torso to which an individual grasps when seated on said enlarged end and wherein said elongated end and said enlarged end generally having a common central axis, wherein said body includes an outer shell of a sheet material having a fastenable section which is readily opened and closed, and an elongated insert of a size and configuration to substantially fill a space within said elongated end of said body and an enlarged insert of a size and configuration to substantially fill a space within said enlarged end of said body and an end of said elongated insert extends into an open surface of said enlarged end to be received therein wherein said inserts are readily insertable through said fastenable section and disposable within said shell such that said fastenable section is closable and said shell encloses said inserts, and wherein said inserts aid to impart a generally uniform softness to each said elongated end and said enlarged end to said body when inserted therein, said body having a size and configuration to enable various aged and sized individuals to sit on said enlarged end and grasp said elongated end, and wherein said body is capable of bending along said elongated end such that said elongated end and said enlarged end have a different central axis, said device to permit varying flexion patterns.

2. The device of claim 1, which further includes a loop portion connectable onto a hook mounted on an overhead support in a manner to substantially provide a soft contact point thereabout.

3. The device of claim 1, wherein said elongated insert is generally cylindrical and said enlarged insert is generally cylindrical doughnut-shaped.

4. The device of claim 1, wherein said sheet material is elastic.

5. The device of claim 1, wherein said insert is of a flexible nature.

6. The device of claim 1, wherein said fastenable section includes a zipper.

7. The device of claim 1, wherein said fastenable section includes a velcro fastener.

* * * * *